US008487539B2

(12) United States Patent
Kuroki et al.

(10) Patent No.: US 8,487,539 B2
(45) Date of Patent: Jul. 16, 2013

(54) POWER SUPPLY FOR AN LED ILLUMINATION DEVICE

(75) Inventors: Yoshifumi Kuroki, Osaka (JP); Shunsuke Shibata, Hyogo (JP)

(73) Assignee: Panasonic Corporation, Osaka (JP)

( * ) Notice: Subject to any disclaimer, the term of this patent is extended or adjusted under 35 U.S.C. 154(b) by 775 days.

(21) Appl. No.: 12/691,984

(22) Filed: Jan. 22, 2010

(65) Prior Publication Data

US 2010/0213858 A1 Aug. 26, 2010

(30) Foreign Application Priority Data

Jan. 22, 2009 (JP) ..... 2009-012412

(51) Int. Cl.
*H05B 37/02* (2006.01)

(52) U.S. Cl.
USPC ..... 315/209 R; 315/308; 315/312

(58) Field of Classification Search
USPC ..... 315/185 R, 209 R, 224–226, 246, 315/247, 291, 294, 307, 308, 312, 324, 360
See application file for complete search history.

(56) References Cited

U.S. PATENT DOCUMENTS 7,759,881 B1 * 7/2010 Melanson ..... 315/307
8,044,600 B2 * 10/2011 Yan et al. ..... 315/219
8,044,608 B2 * 10/2011 Kuo et al. ..... 315/291

FOREIGN PATENT DOCUMENTS

JP 2004327152 11/2004

* cited by examiner

*Primary Examiner* — Jimmy Vu
(74) *Attorney, Agent, or Firm* — Waddey & Patterson, P.C.; Mark J. Patterson; Gary L. Montle

(57) ABSTRACT

An illumination device includes one or more LED's and a power supply configured to convert energy from a commercial AC power source and drive said LED's. The power supply includes a rectifier circuit, a phase detection circuit receiving an output voltage from the rectifier circuit and a switching element. A circuit includes the one or more LED's, an inductive element and a diode, and is coupled on a first end to the rectifier circuit and coupled on a second end to ground through the switching element. A current sensor is positioned to detect a current flowing to the light-emitting diode. A control circuit is coupled to receive the detected current and the detected phase of the rectified output voltage, and further coupled to the switching element and configured to generate a PWM signal for driving the switching element at a frequency higher than a commercial AC frequency. The PWM signal has a pulse width determined in accordance with one or more of a feedback control based on a current detected by the current sensor and a feed-forward control based on a phase of the pulsating voltage detected by the phase detection circuit.

20 Claims, 5 Drawing Sheets

POWER SUPPLY FOR AN LED ILLUMINATION DEVICE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: Japan Patent Application No. 2009-012412, filed Jan. 22, 2009.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to power supplies for LED illumination devices. More particularly, the present invention relates to a compact and inexpensive switching power supply with improved power factor correction for efficiently driving one or more LEDs with a stable current.

Referring to FIG. 9, an example of a conventional power supply as known in the art is shown. A commercial AC power source input Vs is rectified by a full-wave rectifier DB and converted into a DC voltage which is smoothed by a smoothing capacitor C1 to supply a constant current to a light-emitting diode (LED) 3 through a buck converter having a switching element Q, an inductor L and a diode D. A capacitor C2 is connected in parallel with the light-emitting diode 3. A current flowing to the light-emitting diode 3 is detected by a current detecting resistor R and a current detecting amplifier 4 and fed back to a control circuit 1. The control circuit 1 generates a PWM signal for turning on/off the switching element Q and controls an ON time of the PWM signal so that a detected value of the current corresponds to a target value.

In this example, and as shown in FIG. 10, because a capacitor input-type rectifying and smoothing circuit is adopted, the input current waveform is not similar to the input voltage waveform but rather exhibits many higher harmonic components. Even if the power consumed by individual power supplies is small, when a plurality of power supplies with a common structure are connected to the same mains power line in parallel, the effect on other equipment may be considerable.

In a second conventional example as shown in FIG. 11, the smoothing capacitor C1 from the example shown in FIG. 9 is omitted. In this case, because input current flows even in a period when an input voltage is low, as shown in a waveform chart of FIG. 3, the input current waveform is substantially similar to the input voltage waveform and exhibits a sinusoidal current waveform.

However, because the pulsating voltage output from the full-wave rectifier DB becomes low in the period when the input voltage from the commercial AC power source Vs is low, current flow to the inductor L is inhibited even when the switching element Q is turned on. For this reason, as represented by a solid line in FIG. 12, a ripple component of a frequency that is twice as large as that of a frequency of the commercial AC input appears in an output current. A broken line represents an output current waveform in the case where the smoothing capacitor C1 exists (FIG. 9) and a solid line represents an output current waveform in the case where the smoothing capacitor C1 is omitted (FIG. 11).

When the smoothing capacitor C1 is omitted as described above, because the ripple component in the current flowing to the light-emitting diode 3 becomes large, for example, a capacitance of the capacitor C2 connected in parallel to the light-emitting diode 3 needs to be increased, which further increases the size of the power supply. Furthermore, certain operations are undesirably delayed such that even after power is turned off, the light-emitting diode 3 remains lit for a period of time.

In a previously known attempt to address this problem, the LED current is made constant and a power factor of an input current is improved by connecting a step-up chopper circuit to a DC output terminal of a full-wave rectifier and feed-forward controlling an ON period of the switching element according to a pulsating voltage, as well as feedback controlling the ON period so as to suppress variation in a detected value of an output current. Accordingly, the step-up chopper output voltage becomes a DC voltage which is higher than a peak input voltage after full-wave rectification, which is suitable to the case where many light-emitting diodes are serially connected and lit, but is however inefficient in the case where only one or a few light-emitting diodes are lit because power loss increases due to a drop in resistance.

A step-down chopper circuit may also be connected to an output stage of the step-up chopper circuit. However, because power conversion is performed in two stages, circuit losses such as for example in the switches increase and the circuit configuration becomes overly complex.

Thus, it is considered that when the step-down chopper circuit is connected to the DC output terminal of the full-wave rectifier DB without passing through the step-up chopper circuit, the circuit configuration becomes simplified and increased circuit losses such as switching losses can be prevented. However, in the step-down chopper circuit, because a difference between a power source voltage and a load voltage is applied to the inductor upon turning on of the switching element, an input current does not flow in a period when the power source voltage is lower than the load voltage, and an ability to improve an input power factor is limited as compared to the case using the step-up chopper circuit.

BRIEF SUMMARY OF THE INVENTION

In consideration of these matters, an object of the present invention is to provide a compact and inexpensive power supply which can improve the input power factor of the AC power source so as to practically and efficiently drive a one or more LEDs with a stable current.

According to a first embodiment of the present invention, as shown in FIG. 1, there is provided a full-wave rectifier DB for rectifying a commercial AC power source input Vs and outputting a pulsating voltage. A phase detection circuit 2 detects a phase of the pulsating voltage, the phase detection circuit being connected between output terminals of the full-wave rectifier DB. A semiconductor switching element Q is turned on/off at a frequency higher than the commercial AC frequency. A series circuit is formed of a light-emitting diode 3 and an inductive element L, and connected between output terminals of the full-wave rectifier DB through the semiconductor switching element Q. A diode D is connected in parallel with the series circuit formed of the light-emitting diode 3 and the inductive element L with a polarity for blocking current from the full-wave rectifier DB. A current sensor R is adapted to detect a current flowing to the light-emitting diode 3, and a control circuit 1 is provided for generating a PWM signal applied to the semiconductor switching element Q, feedback controlling a pulse width of the PWM signal so as to suppress variation in the current detected by the current sensor R and feed-forward controlling the pulse width of the PWM signal according to a phase of the pulsating voltage detected by the phase detection circuit 2. The number of light-emitting diodes 3 provided may be one, or a number of serially connected light-emitting diodes 3 that is otherwise limited such that a waveform of an input current of the full-wave rectifier DB meets applicable regulations, such as for example the Japanese Class C harmonic regulation.

Because the Class C harmonic regulation can be cleared by limiting the number of serially connected light-emitting diodes as loads for the step-down chopper circuit, even though the step-down chopper circuit has a lesser ability to improve the input power factor than that of the step-up chopper circuit, no longer needing to provide the step-up chopper circuit in the previous stage of the step-down chopper circuit results in a more compact and inexpensive power supply.

According to a second embodiment of the present invention, and as shown in FIGS. 6 and 7, there is provided a full-wave rectifier DB for full-wave rectifying a commercial AC power source input Vs and outputting a pulsating voltage. A phase detection circuit 2 detects a phase of the pulsating voltage, and is connected between output terminals of the full-wave rectifier DB. A semiconductor switching element Q is turned on/off at a frequency sufficiently higher than the commercial AC frequency. An inductive element L is connected between output terminals of the full-wave rectifier DB through the semiconductor switching element Q. A series circuit is formed of a diode D and a light-emitting diode 3 and connected in parallel with the inductive element L, with the series circuit having a polarity for blocking current from the full-wave rectifier DB. A current sensor R is adapted to detect a current to the light-emitting diode 3. A control circuit 1 is provided for generating a PWM signal applied to the semiconductor switching element Q, feedback controlling a pulse width of the PWM signal so as to suppress variation in the current detected by the current sensor R and feed-forward controlling the pulse width of the PWM signal according to the phase of the pulsating voltage detected by the phase detection circuit 2.

According to a third embodiment of the present invention, and as shown in FIG. 8, a full-wave rectifier DB is provided for full-wave rectifying a commercial AC power source input Vs and outputting a pulsating voltage. A phase detection circuit 2 detects a phase of the pulsating voltage, and is connected between output terminals of the full-wave rectifier DB. A semiconductor switching element Q is turned on/off at a frequency sufficiently higher than a commercial AC frequency. A transformer Tr having a primary winding is connected between output terminals of the full-wave rectifier DB through the semiconductor switching element Q. A series circuit is formed of a diode D and a light-emitting diode 3 and connected to a secondary winding of the transformer Tr, the series circuit having a polarity for blocking current when the semiconductor switching element Q is turned on. A current sensor R is adapted to detect a current flowing to the light-emitting diode 3. A control circuit 2 is provided for generating a PWM signal applied to the semiconductor switching element Q, feedback controlling a pulse width of the PWM signal so as to suppress variation in a current detected by the current sensor R and feed-forward controlling the pulse width of the PWM signal according to a phase of the pulsating voltage detected by the phase detection circuit 2.

With regards to the second and third embodiments, because a step-up/step-down chopper circuit or a flyback converter is directly connected to the output terminals of the full-wave rectifier without passing through a smoothing capacitor, and the pulse width of the PWM signal for turning on/off the switching element is forward controlled according to the phase of the pulsating voltage and is feedback controlled according to a current detecting signal of the light-emitting diode, the input power factor from the commercial AC power source can be sufficiently improved without using a step-up chopper circuit. A compact and inexpensive power supply which can efficiently drive one or a small number of light-emitting diodes with a stable current can therefore be realized.

According to a fourth embodiment of the present invention, and as shown in FIGS. 5 and 8, the control circuit 1 may include a time constant circuit (a capacitor C3 and a resistor R3) for determining the pulse width of the PWM signal, and the phase detection circuit includes a resistor R1 for charging the capacitor C3 of the time constant circuit from the pulsating voltage of the full-wave rectifier DB. Therefore, with a simple configuration the pulse width of the PWM signal can be feed-forward controlled according to the phase of the pulsating voltage.

According to a fifth embodiment of the present invention, a charging speed of the capacitor C3 of the time constant circuit is made variable by a transistor Tr1 to which the current detected by the current sensor R is applied. Therefore, with a simple configuration the pulse width of the PWM signal can be feedback controlled according to an output current detecting signal.

According to a sixth embodiment of the present invention, and as shown in FIGS. 6 and 7, the phase detection circuit 2 may include a voltage dividing circuit (resistors R1, R2) for dividing the pulsating voltage output from the full-wave rectifier DB, wherein the control circuit 1 is an oscillating circuit for controlling the pulse width of the PWM signal according to an output voltage of the voltage dividing circuit and a voltage dividing ratio of the voltage dividing circuit is made variable depending on the current detected by the current sensor R. Therefore, with a simple configuration the pulse width of the PWM signal can be feed-forward controlled according to the phase of the pulsating voltage and can be feedback controlled according to an output current detecting signal.

With respect to various embodiments of the present invention, a capacitor C2 having a sufficiently large capacitance may further be connected in parallel with the light-emitting diode 3.

With respect to various embodiments of the present invention, an organic EL element is connected in place of the light-emitting diode 3.

With respect to various embodiments of the power supply of the present invention, an illumination device may further be provided which includes the power supply.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data or other signal.

Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Various embodiments are herein described with respect to the above-mentioned drawings for a power supply configured to efficiently power an illumination device having only a few or even one LED with a stable operating current.

Figure 1:
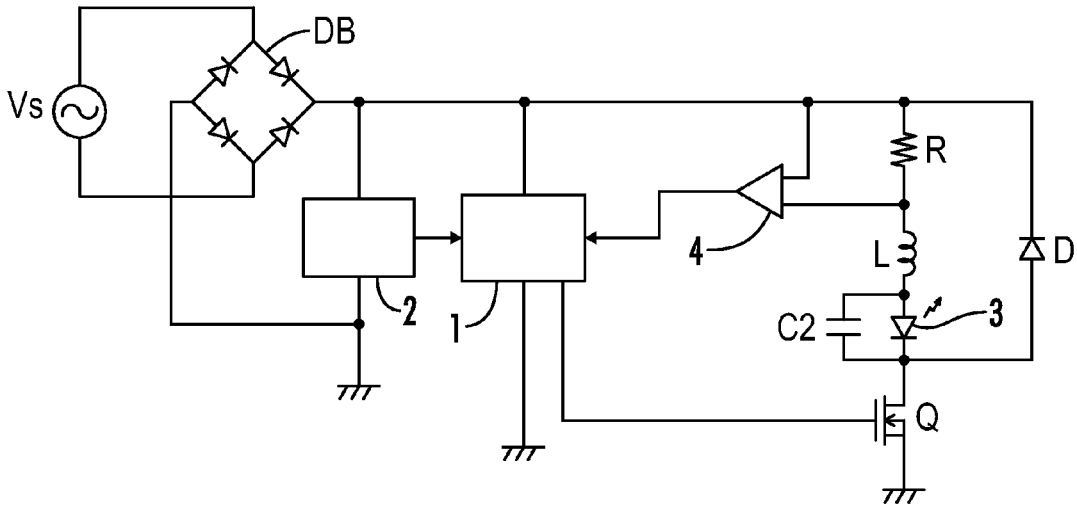
FIG. 1 is circuit diagram of an embodiment of a power supply circuit of the present invention.

Referring to FIG. 1, a commercial AC power source input Vs is rectified by a full-wave rectifier DB and converted into a pulsating voltage. An output terminal on a positive side of the full-wave rectifier DB is connected to one end of a current sensor, in the embodiment shown a current detecting resistor R. The other end of the current detecting resistor R is connected to a switching element Q, in this case to the drain of a MOSFET, through a series circuit formed of an inductor L and a light-emitting diode (LED) D3. A capacitor C2 having a large capacitance is connected in parallel across the LED 3. The source of the switching element Q is grounded and connected to an output terminal on a negative side of the full-wave rectifier DB. A diode D for passing a regenerating current is connected to a series circuit formed of the current detecting resistor R, the inductor L and the light-emitting diode 3 with a polarity for blocking current from the full-wave rectifier DB. A PWM signal supplied from a control circuit 1 is applied to the switching element Q. The PWM signal is a high-frequency rectangular wave voltage, and when the signal is in a High level the switching element Q is turned on, and when the signal is in a Low level the switching element Q is turned off.

The switching element Q, the inductor L and the diode D constitute a buck converter as is well-known in the art. When the switching element Q is turned on, a current flows from the output terminal on the positive side of the full wave rectifier DB to the current detecting resistor R, the inductor L, the light-emitting diode 3, the switching element Q and the output terminal on the negative side of the full wave rectifier DB, in this order. This current becomes a gradually increasing current having a rate of change determined depending on an inductance value of the inductor L and a voltage consisting of a pulsating voltage after full-wave rectification minus load voltage. When the switching element Q is turned off, a regenerating current flows to the inductor L, the light-emitting diode 3, the diode D, the current detecting resistor R and the inductor L in this order due to stored energy of the inductor L. This current becomes a gradually decreasing current having a rate of change determined depending on an inductance value of the inductor L and a load voltage. Here, it is assumed to perform a continuous operation wherein the switching element Q is turned on again before the gradually decreasing current reaches 0.

Figure 4:
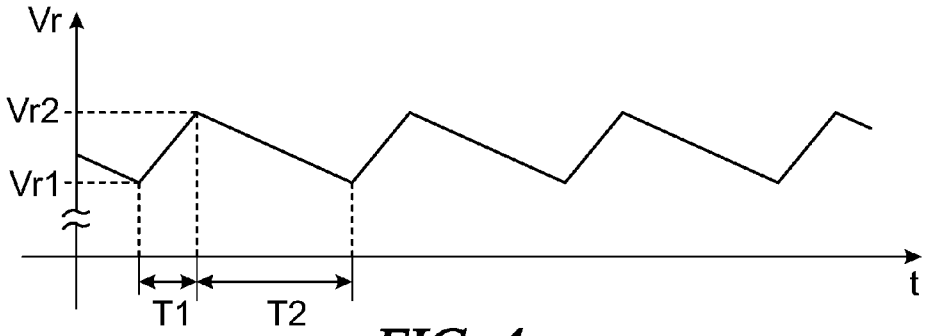
FIG. 4 is a waveform diagram graphically representing a waveform of a switching current of the embodiment of FIG. 1.

Referring now to FIG. 4, a voltage Vr across the current detecting resistor R is shown, which is further detected by a current detecting amplifier 4. A rate of change of the gradually increasing current flowing in an ON period T1 of the switching element Q increases when the pulsating voltage after full-wave rectification is high and decreases when the pulsating voltage after full-wave rectification is low. The rate of change of the gradually decreasing current flowing in an OFF period T1 of the switching element Q is substantially constant because the load voltage of the LED 3 is substantially constant.

The current detecting amplifier 4 may use, for example, an operational amplifier. The operational amplifier may have an integration time constant as a feedback impedance. When the integration time constant is set to be longer than the switching cycle of the switching element Q, an average value of the current flowing to the current detecting resistor R, that is, an average value of a current flowing to the LED 3 ((Vr1+Vr2)/2 in FIG. 4) can be detected as an output from the current detecting amplifier 4.

The control circuit 1 in various embodiments may include a differential amplifier using, for example, an operational amplifier and a PWM oscillator, compare a target value with the output from the current detecting amplifier 4 by the differential amplifier, receive an output from the differential amplifier and perform a feedback control so as to increase/decrease an ON time of the switching element Q by the PWM oscillator so that the average value of the current flowing from the current detecting amplifier 4 to the LED 3 corresponds to the target value. Specifically, when the average value of the current flowing from the current detecting amplifier 4 to the LED 3 is smaller than the target value, it is controlled to increase the ON time of the switching element Q. Conversely, when the average value of the current flowing from the current detecting amplifier 4 to the LED 3 is larger than the target value, it is controlled to decrease the ON time of the switching element Q.

Figure 2:
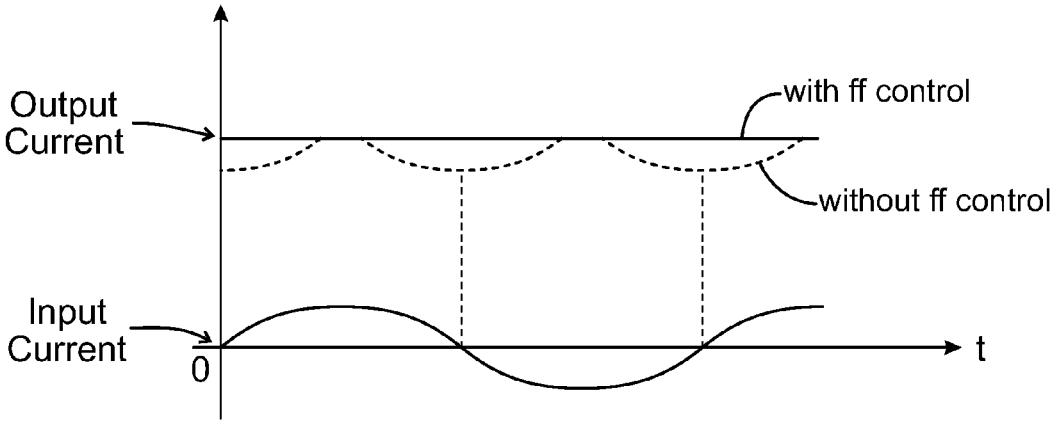
FIG. 2 is a waveform diagram graphically representing a relationship between an input voltage and an output current of the embodiment of FIG. 1.

FIG. 2 illustrates an example of operation for an embodiment as described. When the input voltage from the commercial AC power source Vs is near a peak, the output current is controlled to be constant by the above-mentioned feedback control. Meanwhile, in a period when the input voltage from the commercial AC power source Vs is not near a peak, the output current as represented by a broken line in FIG. 2 is corrected so as to be pulled up, as represented by a solid line in FIG. 2, according to a feed-forward control (abbreviated as "FF control") using a signal from the phase detection circuit 2.

The broken line in FIG. 2 represents an output current in the case where feed-forward control is not performed and the solid line in FIG. 2 represents an output current in the case where feed-forward control is performed. Because the pulsating voltage after full-wave rectification by the full-wave rectifier DB is low in a period when the input voltage from the commercial AC power source Vs is low, even when the switching element Q is turned on, current flow to the inductor L is inhibited. For this reason, when the feed-forward control is not performed, as represented by the broken line in FIG. 2, a ripple component having a frequency twice as large as the commercial AC frequency appears in the output current.

In various embodiments a phase detection circuit 2 may be connected to the output from the full-wave rectifier DB, and a target value of the feedback control by the control circuit 1 may be variably controlled according to a power supply phase detected by the phase detection circuit 2. The phase detection circuit 2 may include a plurality of resistors connected in series and supply a power source detecting signal obtained by dividing the pulsating voltage output from the full-wave rectifier DB to the control circuit 1. When the power supply detecting signal becomes large, the target value of the feedback control is corrected to be small. Conversely, when the power supply detecting signal becomes small, the target value of the feedback control is corrected to be large. By performing such a feed-forward control in the period when the input voltage from the commercial AC power source Vs is low, the ON time of the switching element Q is corrected to be extended, thereby controlling the average value of the current flowing to the LED 3 to be a constant value close to the target value.

In an embodiment as shown in FIG. 1, when the input voltage from the commercial AC power source Vs approaches a zero crossing, a delay time for the input current flow begins. In other words, in a period when the pulsating voltage after full-wave rectification by the full-wave rectifier DB is lower than the voltage of the capacitor C2, the full-wave rectifier DB is in a blocked state and thus the input current does not flow. The delay time of the input current becomes longer as the number of LEDs 3 connected in series increases. In an embodiment as shown in FIG. 1, the number of series-connected LEDs 3 is therefore limited.

When the forward drop voltage Vf of the LED 3 is 3.5V, and if the number of serially-connected LEDs N is 3 or 4, a total forward drop voltage N×Vf is about 10.5V to 14V. Although an input voltage which is lower than the above-mentioned voltage stops the input current flow, it is unlikely that such an amount of voltage would be against for example the Japanese Class C harmonic regulation (JIS C 61000-3-2) as previously mentioned.

Figure 3:
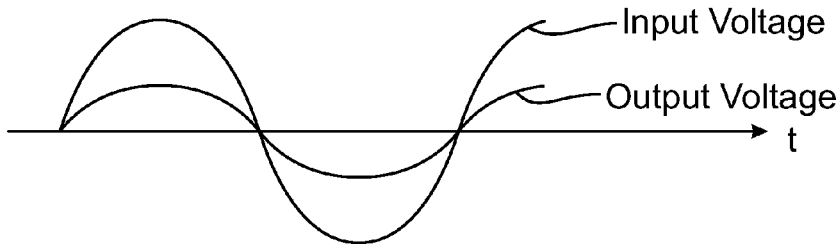
FIG. 3 is a waveform diagram graphically representing a relationship between an input voltage and an input current of the embodiment of FIG. 1.

In practice, a filter circuit for removing high-frequency switching noise may be introduced on a side of an AC input terminal of the full-wave rectifier DB. As shown in FIG. 3, the input current from the commercial AC power source Vs exhibits a sinusoidal waveform which is substantially similar to that of the input voltage, thereby achieving an illumination device having a high input power factor.

Figure 5:
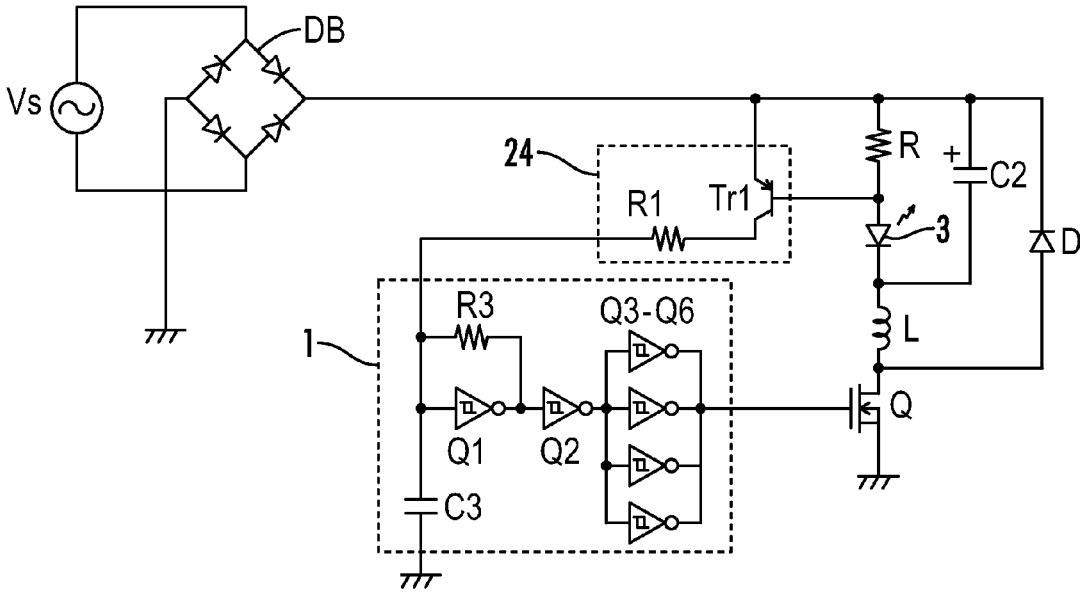
FIG. 5 is a circuit diagram of another embodiment of the power supply circuit of the present invention.

Referring now to FIG. 5, in another embodiment a configuration of the power supply may be simplified by combining the phase detection circuit 2 and the current detecting amplifier 4 into one detecting circuit 24. Furthermore, a simple CR oscillator may be used as the control circuit 1. A pulse width of the CR oscillator is variably controlled according to a current flowing from the full-wave rectifier DB through the detecting circuit 24.

The CR oscillator in an embodiment includes a time constant setting capacitor C3, a resistor R3 and a Schmitt inverter Q1. The Schmitt inverter Q1 is a hysteresis inverter in which the output voltage is in a Low level when the input voltage is higher than a threshold value Vth1 and in a High level when the input voltage is lower than a threshold value Vth2 (<Vth1). Because six inverters are generally available in the market on a single-chip IC, the other inverters Q2 to Q6 as shown are used as MOSFET driving buffers. However, various equivalent structures are of course anticipated and the configuration is not limited to the use of six inverters.

When no current flows from the detecting circuit 24, the capacitor C3 is charged by an output from the Schmitt inverter Q1 in the High level through the resistor R3. When the charging voltage reaches a threshold value Vth1, an output from the Schmitt inverter Q1 is in the Low level. A charging voltage of the capacitor C3 is discharged through the resistor R3 and when the charging voltage reaches a threshold value Vth2 (<Vth1), the output from the Schmitt inverter Q1 is in the High level. By repeating the operation, the switching element Q is turned on/off. A DC voltage thereby charges the capacitor C2 by a step-down chopper operation, and DC current flows to the LED 3 through the current detecting resistor R. Thereby, a transistor Tr1 is biased between a base and an emitter, energizing the detecting circuit 24.

When current flows from the detecting circuit 24, as the current increases a time required to charge the capacitor C3 becomes shorter and a time required to discharge the capacitor C3 becomes longer, resulting in that an ON time of the switching element Q becomes shorter and an OFF time of the switching element Q becomes longer.

When the current flowing to the LED 3 increases, a resistance value of the transistor Tr1 decreases and a current supplied to the control circuit 1 through the resistor R1 increases, wherein the ON time of the switching element Q becomes shorter and the OFF time of the switching element Q becomes longer. Conversely, when the current flowing to the LED 3 decreases, a resistance value of the transistor Tr1 increases and the current supplied to the control circuit 1 through the resistor R1 decreases, wherein the ON time of the switching element Q becomes longer and the OFF time of the switching element Q becomes shorter.

When a pulsating voltage output from the full-wave rectifier DB increases, even if the resistance value of the transistor Tr1 remains, the current supplied to the control circuit 1 through the resistor R1 increases and therefore the ON time of the switching element Q becomes shorter and the OFF time of the switching element Q becomes longer. Conversely, when the pulsating voltage output from the full-wave rectifier DB decreases, even if the resistance value of the transistor Tr1 remains, the current supplied to the control circuit 1 through the resistor R1 decreases and therefore the ON time of the switching element Q becomes longer and the OFF time of the switching element Q becomes shorter.

In this manner, a pulse width of a PWM signal can be feedback controlled so as to suppress variation in the current detected by the current detecting resistor R, and the pulse width of the PWM signal can be feed-forward controlled according to a phase of the pulsating voltage output from the full-wave rectifier DB.

Although a power supply for the control circuit 1 is not shown, a power supply capacitor may for example be charged from the output from the full-wave rectifier DB through a step-down resistor to use a voltage made constant by a zener diode. Alternatively, the inductor L may be provided with a secondary winding to use its flyback output to charge the power supply capacitor. The same also applies to alternative embodiments as further described below.

Figure 6:
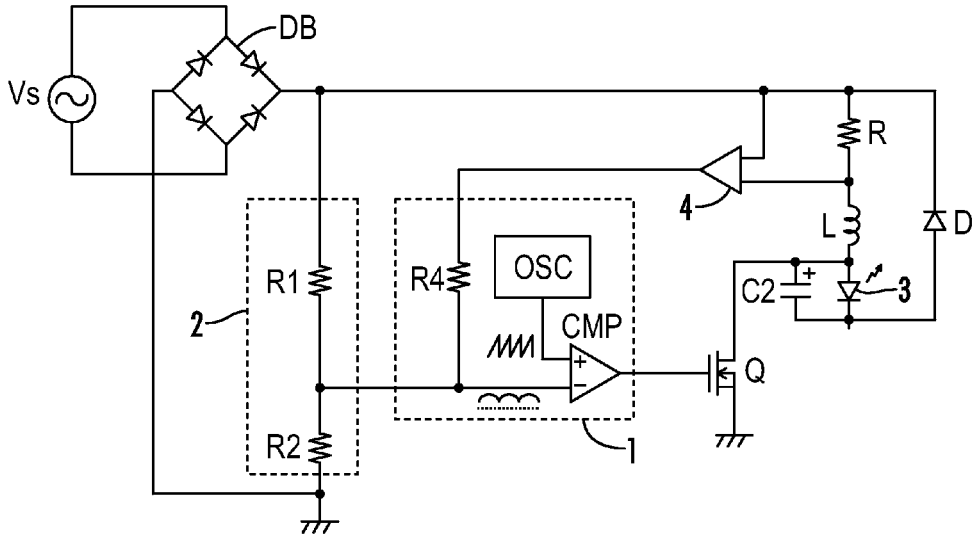
FIG. 6 is a circuit diagram of another embodiment of the power supply circuit of the present invention.

Referring now to FIG. 6, the position of the switching element Q is altered with respect to the configuration shown in FIG. 1 such that a node between the inductor L and the LED 3 is periodically dropped to a ground potential. This is a configuration of a so-called step-up/step-down chopper circuit (polarity inversion chopper circuit). As with the previous embodiments, the control circuit 1 performs a feed-forward control by detection of an input voltage as well as a feedback control by detection of an output current.

In embodiments as previously described with reference to FIG. 1 for example, because the step-down chopper circuit (buck converter) is used as a switching power source, the delay time of the input current is necessarily generated in a period when an input voltage is lower than the load voltage. With regards to configurations previously known in the art, the step-up chopper circuit may be advantageously used as the switching power supply, and the delay time of the input current is not generated even in the vicinity of the zero crossing where the input voltage is low. However, the load voltage disadvantageously becomes a high voltage which is higher than the peak voltage after full-wave rectification, which is inefficient for the case of driving one or only a few LED's.

Conversely, in embodiments such as shown in FIG. 6, by adopting a configuration using the so-called step-up/step-down chopper circuit (polarity inversion chopper circuit) as the switching power source, one or a few LEDs can be efficiently driven while improving an input power factor.

Even in a period when a pulsating voltage after full-wave rectification by the full-wave rectifier DB is lower than a voltage of the capacitor C2, when the switching element Q is turned on a current flows to an output terminal on a positive side of the full wave rectifier DB, the current detecting resistor R, the inductor L, the switching element Q and an output terminal on a negative side of the full wave rectifier DB in this order, and therefore the delay time of the input current is not initiated. The current becomes a gradually increasing current having a rate of change based on an inductance value of the inductor L and the pulsating voltage after full-wave rectification. When the switching element Q is turned off, a regenerating current flows to the inductor L, the light-emitting diode 3, the diode D, the current detecting resistor R and the inductor L in this order due to stored energy of the inductor L. This current becomes a gradually decreasing current having a rate of change based on the inductance value of the inductor L and a load voltage. A voltage Vr detected by the current detecting resistor R has the same waveform as that in FIG. 4. Here again, a continuous operating mode is assumed wherein the switching element Q is turned on again before the gradually decreasing current reaches 0.

Next, an embodiment of the control circuit 1 such as shown in FIG. 6 will be described. The control circuit 1 includes an oscillator OSC for generating a high-frequency saw-tooth waveform voltage, and a comparator CMP. The comparator CMP compares the voltage of at its positive input terminal with a voltage at its negative input terminal. When the voltage at the positive input terminal is higher than the voltage at the negative input terminal, the comparator output is in a High level, and when the voltage at the positive input terminal is lower than the voltage at the negative input terminal, the comparator output is in a Low level.

The output voltage of the phase detection circuit 2 is applied to the negative input terminal of the comparator CMP. Here, the phase detection circuit 2 is a simple voltage dividing circuit and divides the pulsating voltage output from the full-wave rectifier DB. An output from the current detecting amplifier 4 is provided to the negative input terminal of the comparator CMP through a resistor R4. Therefore, when a current flowing to the light-emitting diode 3 increases or the pulsating voltage output from the full-wave rectifier DB increases, the voltage at the negative input terminal of the comparator CMP increases and an ON time of the PWM signal becomes shorter. Conversely, when the current flowing to the LED 3 decreases or the pulsating voltage output from the full-wave rectifier DB decreases, the voltage at the negative input terminal of the comparator CMP decreases and the ON time of the PWM signal becomes longer. Thereby, a pulse width of the PWM signal can be feedback controlled so as to suppress modulation in the current detected by the current detecting resistor R, and the pulse width of the PWM signal can be feed-forward controlled according to a phase of the pulsating voltage output from the full-wave rectifier DB.

Figure 7:
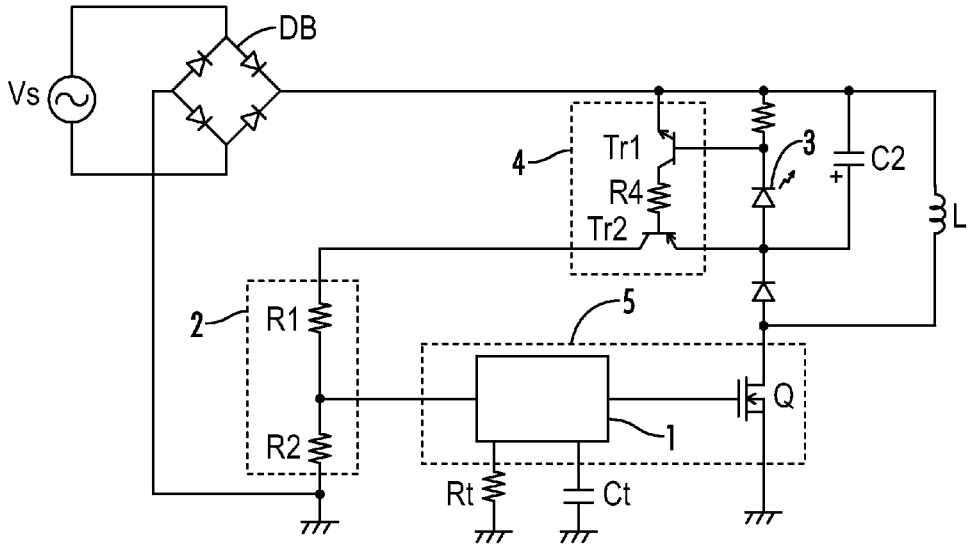
FIG. 7 is a circuit diagram of another embodiment of the power supply circuit of the present invention.

Referring now to an embodiment as shown in FIG. 7, even in the period when the pulsating voltage after full-wave rectification by the full-wave rectifier DB is lower than the voltage of the capacitor C2, when the switching element Q is turned on a current flows to the output terminal on the positive side of the full wave rectifier DB, the inductor L, the switching element Q and the output terminal on the negative side of the full-wave rectifier DB in this order, and therefore the delay time of the input current is not generated. This current becomes a gradually increasing current having a rate of change determined depending on the inductance value of the inductor L and the pulsating voltage after full-wave rectification. When the switching element Q is turned off, the regenerating current flows to the inductor L, the diode D, the light-emitting diode 3, the current detecting resistor R and the inductor L in this order due to the stored energy of the inductor L. This current becomes a gradually decreasing current having a rate of change determined depending on the inductance value of the inductor L and the load voltage. The voltage detected by the current detecting resistor R becomes a DC voltage smoothed by the capacitor C2, as a ripple component in the ON/OFF cycle of the switching element Q is removed.

The current detecting amplifier 4 in FIG. 7 may now be described. The current detecting amplifier 4 uses the capacitor C2 as a power source. When a current flowing to the current detecting resistor R increases, a bias between the base and emitter of the transistor Tr1 increases, thereby decreasing a resistance value between the base and the emitter of the transistor Tr1. Current flowing to a positive electrode of the capacitor C2, an emitter of the transistor Tr2, a base of the transistor Tr2, the resistor R4, the collector of the transistor Tr1, the emitter of the transistor Tr1 and a negative electrode of the capacitor C2 in this order increases. Therefore, as the current flowing to the light-emitting diode 3 increases, a resistance value between the emitter and the collector of the transistor Tr2 decreases. Because the current flowing to the output terminal on the positive side of the full-wave rectifier DB, the capacitor C2, the transistor Tr2, the resistor R1, the resistor R2 and the output terminal on the negative side of the full-wave rectifier DB increases, a voltage across the resistor R2 reflects the current flowing to the LED 3 and the pulsating voltage of the full-wave rectifier DB. The control circuit 1 decreases the ON time of the PWM signal as the voltage across the resistor R2 increases.

In various embodiments, the control circuit 1 and the switching element Q constitute an integrated circuit 5 on a single chip. The control circuit 1 built in the integrated circuit 5 may be a PWM oscillator and its oscillating frequency is determined based on a resistor Rt externally attached to the integrated circuit 5 and a time constant of the capacitor Ct. Furthermore, by connecting an OFF time setting terminal of the integrated circuit 5 to a node between the resistor R1 and the resistor R2 of the phase detection circuit 2, when the voltage across the resistor R2 increases, an OFF time increases and the ON time of the PWM signal decreases. In this manner, the pulse width of the PWM signal can be feed-back controlled so as to suppress modulation in the current detected by the current detecting resistor R, and the pulse width of the PWM signal can be feed-forward controlled according to the phase of the pulsating voltage output from the full-wave rectifier DB.

In an embodiment as shown in FIG. 1, the frequency of the PWM signal may vary in the control circuit 1, while the frequency of the PWM signal may be fixed in embodiments of the control circuit 1 for example as shown in FIGS. 6 and 7, and therefore, it is easy to design a noise filter. It is anticipated that configurations of the control circuit 1 as described with respect to any of the above-mentioned embodiments may generally be used in other embodiments as may be understood by those of skill in the art.

Figure 8:
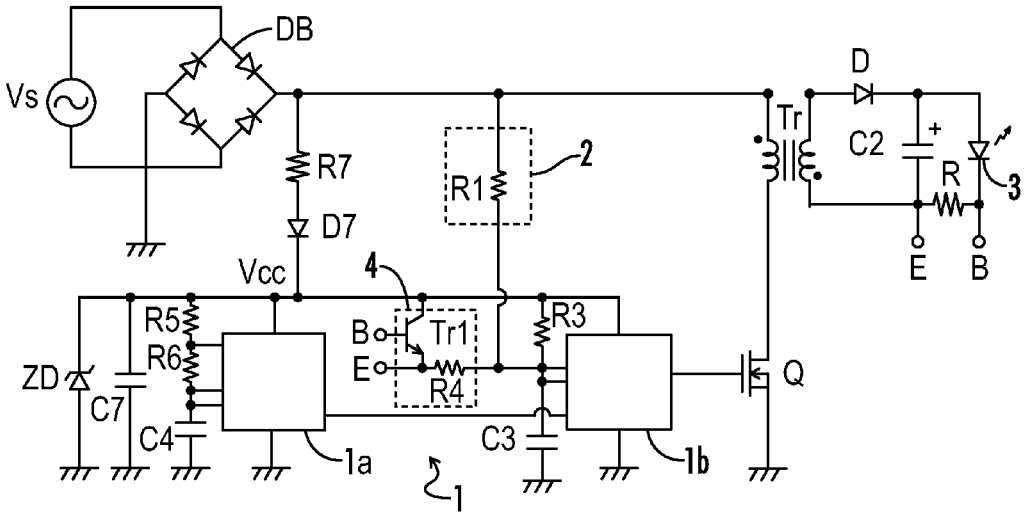
FIG. 8 is a circuit diagram of another embodiment of the power supply circuit of the present invention.
Figure 9:
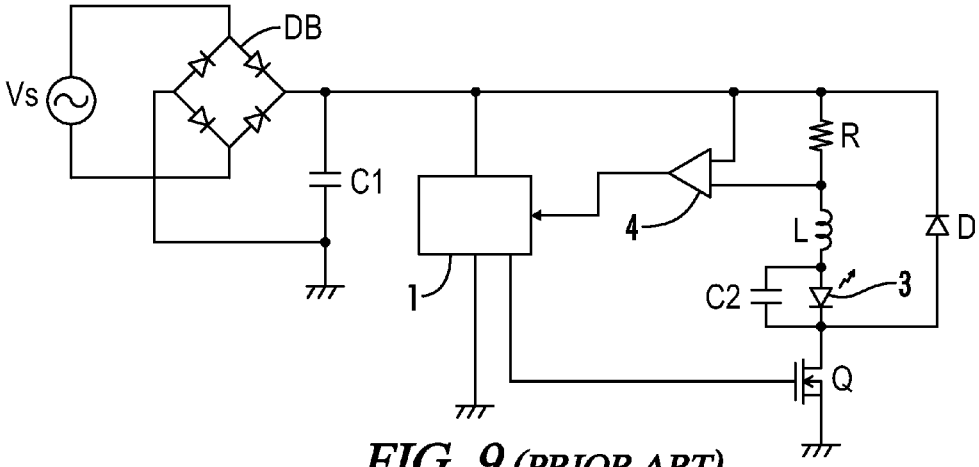
FIG. 9 (PRIOR ART)
FIG. 9 is a circuit diagram of a power supply circuit as previously known in the art.
Figure 10:
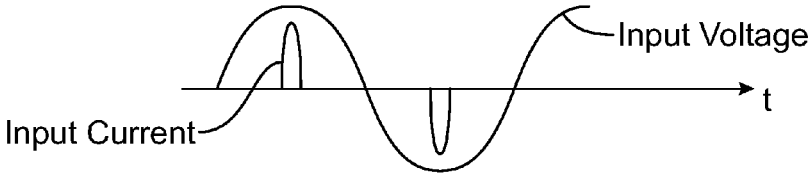
FIG. 10 (PRIOR ART)
FIG. 10 is a waveform diagram graphically representing a relationship between an input voltage and an input current in the circuit of FIG. 9.
Figure 11:
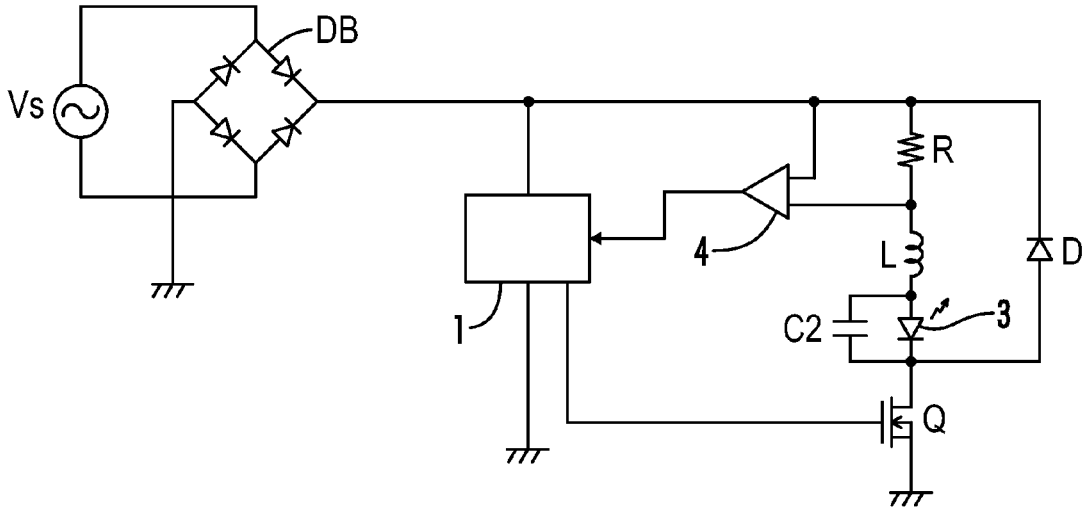
FIG. 11 (PRIOR ART)
FIG. 11 is a circuit diagram of another power supply circuit as previously known in the art.
Figure 12:
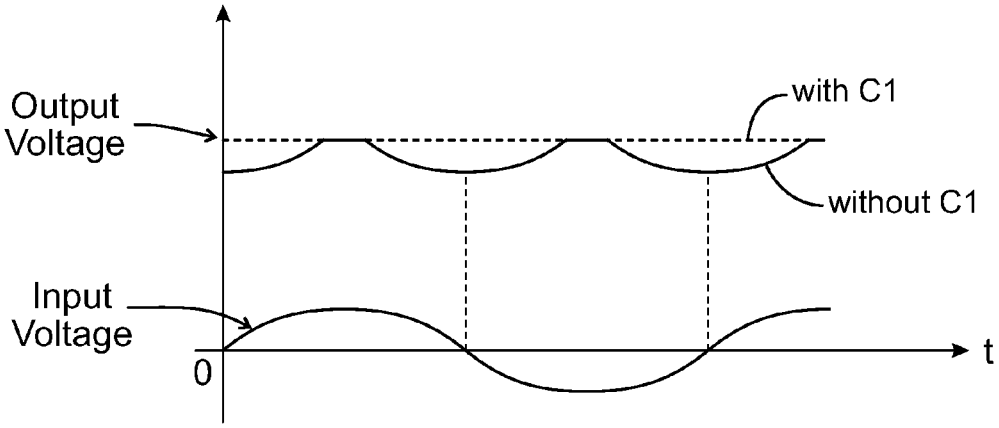
FIG. 12 (PRIOR ART)
FIG. 12 is a waveform diagram graphically representing for showing a relationship between an input voltage and an output current in the circuit of FIG. 11.

Referring now to another embodiment as shown in FIG. 8, a flyback converter is provided in which the inductor L (see FIG. 7) is substituted for by a transformer Tr. In this circuit, even in a period when a pulsating voltage after full-wave rectification by the full-wave rectifier DB is lower than a voltage of the capacitor C2, when the switching element Q is turned on a current flows to an output terminal on a positive side of the full wave rectifier DB, a primary winding of the transformer Tr, the switching element Q and an output terminal on a negative side of the full wave rectifier DB in this order, and therefore a delay time of an input current is not generated. This current becomes a gradually increasing current having a rate of change determined based on a winding inductance of the transformer Tr and the pulsating voltage after full-wave rectification. When the switching element Q is turned off, a flyback current flows to a secondary winding of the transformer Tr, the diode D, the LED 3, the current detecting resistor R and the secondary winding of the transformer Tr in this order due to stored energy of the transformer Tr. This current becomes a gradually decreasing current having a rate of change determined based on a winding inductance of the transformer Tr and a load voltage. A detected voltage detected by the current detecting resistor R becomes a DC voltage smoothed by the capacitor C2 removing a ripple component in an ON/OFF cycle of the switching element Q.

The control circuit 1 in FIG. 8 may be provided by combining an astable multi-vibrator 1*a* formed of a timer IC with a monostable multi-vibrator 1*b* for receiving an oscillating output from the astable multi-vibrator 1*a* and outputting a single-shot ON pulse signal. Because the timer IC may be for example a well-known NE555 device, and an IC having two timers therein are commercially available, the control circuit can be inexpensively achieved by externally attaching resistors R3 to R6 and capacitors C3, C4 thereto. The oscillating frequency of the astable multi-vibrator 1*a* is determined by the resistors R5, R6 and the capacitor C4, and the output pulse width of the monostable multi-vibrator is determined by a time constant associated with predetermined values of the resistor R3 and the capacitor C3. A power source circuit for the timer IC may include for example a resistor R7, a diode D7, a capacitor C7 and a zener diode ZD.

In embodiments as shown in FIG. 8, because an isolating transformer Tr is used, a potential of the current detecting resistor R is not limited, and therefore the current detecting amplifier 4 can be disposed more freely. Here, a series circuit formed of the transistor Tr1 and the resistor R4 is connected in parallel with the resistor R3 of the time constant circuit for determining an output pulse width of the monostable multi-vibrator 1*b* of the timer IC. A base terminal B and an emitter terminal E of the transistor Tr1 are connected across the current detecting resistor R. When a current flowing to the current detecting resistor R increases, a resistance value between a collector and an emitter of the transistor Tr1 lowers and a time constant of the monostable multi-vibrator 1*b* decreases. A feedback control is therefore performed so as to shorten an output pulse width of the monostable multi-vibrator 1*b*. A path for charging the capacitor C3 from the pulsating voltage of the full-wave rectifier DB through the resistor R1 is provided separately from a path for discharging the capacitor C3 through the resistor R3 or the resistor R4. Thereby, when the pulsating voltage increases, the feed-forward control is performed so as to increase a charging speed of the capacitor C3 and shorten the output pulse width of the monostable multi-vibrator 1*b*.

In each of the above-mentioned embodiments, although the switching element Q can be inexpensively realized as an n-channel MOSFET, the n-channel MOSFET may be replaced with a bipolar transistor or an IGBT.

Although one LED 3 is illustrated, a plurality of LEDs 3 may be connected in a serial, parallel or serial-parallel fashion. Furthermore, an organic EL element (OLED) may be connected in place of the LED 3.

An illumination device using a power supply according to any of the various embodiments of the present invention can control an average current flowing to a light-emitting element with a high accuracy. Therefore, for example, an average value flowing to each of a red LED, a green LED and a blue LED as light sources can be controlled with a high accuracy, resulting in that a compact LED illumination device may obtain a color temperature of various colors such as bluish white light and warm white light with a high accuracy. Furthermore, because significant size reduction can be achieved by unifying the control circuit 1 and the switching element Q into an integrated circuit, a compact LED illumination device which can be exchanged with an existing incandescent bulb can be realized.

Thus, although there have been described particular embodiments of the present invention of a new and useful Power Supply for an LED Illumination Device it is not intended that such references be construed as limitations upon the scope of this invention except as set forth in the following claims.

What is claimed is:

1. A power supply for powering one or more light-emitting diodes comprising:

a rectifier circuit coupled to a commercial AC power source and configured to provide a pulsating rectified voltage output;

a switching element;

a series circuit comprising the one or more light-emitting diodes and an inductive element, the series circuit coupled on a first end to the rectifier circuit and coupled on a second end to ground through the switching element;

a diode coupled in parallel with the series circuit;

a current sensor positioned to detect a current flowing to the light-emitting diode;

a detection circuit coupled to detect a phase of the rectified voltage output, the detection circuit comprising a transistor coupled across the current sensor and a resistor coupled on a first end to the transistor; and a control circuit coupled to the switching element and to a second end of the resistor in the detection circuit, the control circuit configured to generate a PWM signal for driving the switching element at a frequency higher than a commercial power source AC frequency, the PWM signal having a pulse width determined in accordance with one or more of a feedback control based on a current detected by the current sensor and a feed-forward control based on a phase of the pulsating voltage detected by the detection circuit.

2. The power supply of claim 1, wherein the control circuit includes a timer circuit comprising a timing circuit capacitor, the timer circuit being functional to determine the pulse width of the PWM signal, and wherein the detection circuit includes a resistor for charging the timer circuit capacitor from the pulsating voltage of the rectifier circuit.

3. The power supply of claim 2, further comprising a transistor coupled across the current sensor, wherein a charging time for the timer circuit capacitor is variable in accordance with a transistor output based on the detected current.

4. The power supply of claim 3, wherein the detection circuit includes a voltage dividing circuit for dividing the rectified voltage output, the control circuit comprises an oscillating circuit for controlling the pulse width of the PWM signal according to an output voltage of the voltage dividing circuit, and a voltage dividing ratio of the voltage dividing circuit is made variable depending on the current detected by the current sensor.

5. The power supply of claim 4, wherein a capacitor is coupled in parallel to the light-emitting diode.

6. The power supply of claim 5, wherein an organic EL element is connected in place of the light-emitting diode.

7. A power supply comprising:

a full-wave rectifier coupled to a commercial AC power source and configured to provide a pulsating voltage output;

a phase detection circuit coupled across the full-wave rectifier;

a switching element;

an inductive element connected across the full-wave rectifier through the switching element;

a series circuit comprising a diode and a light-emitting diode, the series circuit coupled in parallel with the inductive element and having a polarity for blocking a current from the full-wave rectifier;

a current sensor adapted to detect a current flowing to the light-emitting diode; and a control circuit coupled to the switching element and configured to generate a PWM signal for driving the switching element, the PWM signal having a pulse width determined in accordance with one or more of a feedback control based on a current detected by the current sensor and a feed-forward control based on a phase of the pulsating voltage detected by the phase detection circuit.

8. The power supply of claim 7, the control circuit further configured to generate a PWM signal for driving the switching element at a frequency higher than a commercial AC frequency.

9. The power supply of claim 8, wherein the series circuit further comprises the current sensor, and wherein the current sensor is coupled in parallel with the inductive element.

10. The power supply of claim 9, the inductive element further comprising a transformer having a primary winding coupled across the full-wave rectifier and through the semiconductor switching element, and wherein the series circuit comprising the diode and the light-emitting diode is coupled to a secondary winding of the transformer with a polarity for blocking a current provided when the switching element is turned on.

11. The power supply of claim 10, wherein the control circuit includes a timer circuit for determining the pulse width of the PWM signal, the timer circuit comprises a timing circuit capacitor, and wherein the phase detection circuit includes a resistor for charging the timing circuit capacitor from the pulsating voltage of the rectifier circuit.

12. The power supply of claim 11, further comprising a current detecting amplifier coupled across a resistor associated with the timer circuit, wherein a charging speed for the timing circuit capacitor is variable in accordance with a current detecting amplifier output based on the detected current.

13. The power supply of claim 7, further comprising a transistor coupled across the current sensor, the control circuit includes a timer circuit for determining the pulse width of the PWM signal, and the phase detection circuit includes a resistor for charging the timing circuit capacitor from the pulsating voltage of the rectifier circuit, wherein a charging time for the timing circuit capacitor is variable in accordance with a transistor output based on the detected current.

14. The power supply of claim 7, wherein the phase detection circuit includes a voltage dividing circuit for dividing the rectified voltage output, the control circuit comprises an oscillating circuit for controlling the pulse width of the PWM signal according to an output voltage of the voltage dividing circuit, and a voltage dividing ratio of the voltage dividing circuit is made variable depending on the current detected by the current sensor.

15. A power supply for powering one or more light-emitting diodes comprising:

a rectifier circuit coupled to a commercial AC power source and configured to provide a pulsating rectified voltage output;

a phase detection circuit coupled to detect a phase of the rectified voltage output;

a switching element;

a series circuit comprising the one or more light-emitting diodes and an inductive element, the series circuit coupled on a first end to the rectifier circuit and coupled on a second end to ground through the switching element;

a diode coupled in parallel with the series circuit;

a current sensor positioned to detect a current flowing to the light-emitting diode; and a control circuit coupled to the switching element and configured to generate a PWM signal for driving the switching element at a frequency higher than a commercial power source AC frequency, the control circuit further comprising a timer circuit comprising a timing circuit capacitor, the timer circuit being functional to determine the pulse width of a PWM signal further in accordance with one or more of a feedback control based on a current detected by the current sensor and a feed-forward control based on a phase of the pulsating voltage detected by the phase detection circuit, the phase detection circuit further comprising a resistor for charging the timer circuit capacitor from the pulsating voltage of the rectifier circuit.

16. The power supply of claim 15, further comprising a current detecting amplifier coupled across the current sensor and having an amplifier output associated with a current detected by the current sensor.

17. The power supply of claim 16, wherein the current detecting amplifier and the phase detection circuit together collectively comprise a detecting circuit, the detecting circuit comprising a transistor coupled across the current sensor and a resistor coupled on a first end to the transistor and on a second end to the control circuit.

18. The power supply of claim 16, wherein the phase detection circuit is coupled to the amplifier and configured to receive the amplifier output.

19. The power supply of claim 15, further comprising a transistor coupled across the current sensor, wherein a charging time for the timer circuit capacitor is variable in accordance with a transistor output based on the detected current.

20. The power supply of claim 19, wherein the phase detection circuit includes a voltage dividing circuit for dividing the rectified voltage output, the control circuit comprises an oscillating circuit for controlling the pulse width of the PWM signal according to an output voltage of the voltage dividing circuit, and a voltage dividing ratio of the voltage dividing circuit is made variable depending on the current detected by the current sensor.

* * * * *